US006339922B1

(12) United States Patent
Foster

(10) Patent No.: US 6,339,922 B1
(45) Date of Patent: Jan. 22, 2002

(54) JEWELRY CHAIN

(76) Inventor: Arthur S. Foster, 18 Horseshoe La., Commack, NY (US) 11725

( * ) Notice: Subject to any disclaimer, the term of this patent is extended or adjusted under 35 U.S.C. 154(b) by 0 days.

(21) Appl. No.: 09/838,374

(22) Filed: Apr. 19, 2001

(51) Int. Cl.[7] ..... F16G 15/00
(52) U.S. Cl. ..... 59/80; 59/83; 59/85
(58) Field of Search ..... 59/80, 83, 84, 59/85

(56) References Cited

U.S. PATENT DOCUMENTS

| | | | | | |
|---|---|---|---|---|---|
| 1,414,638 A | * | 5/1922 | Grove | ..... | 59/80 |
| 1,655,763 A | | 1/1928 | Fulford | | |
| 2,007,445 A | | 7/1935 | Goldenberg | ..... | 59/80 |
| D177,102 S | * | 3/1956 | Katz | ..... | 59/80 |
| 5,636,506 A | | 6/1997 | Yngvesson | ..... | 59/80 |
| 5,664,410 A | | 9/1997 | Nydick | ..... | 59/80 |
| 6,055,802 A | | 5/2000 | DiVietri | ..... | 59/80 |

* cited by examiner

*Primary Examiner*—David Jones
(74) *Attorney, Agent, or Firm*—Richard L. Miller

(57) ABSTRACT

An improved jewelry chain of a type having a plurality of links. Each link resembles a fish hook and has a shank with one end thereof having a barbed hook thereon and an opposite end thereof having an eyelet thereon which engages the barbed hook of an adjacent link. The eyelet lies in a first plane and the shank and barbed hook lie in a second plane that is perpendicular to the first plane. The improvements include the barbed hook not touching the shank, the eyelet being so sized so as not to allow the barbed hook of an adjacent link to pass therethrough, except for the eyelet of one terminal link being large enough to allow the barbed hook of the other terminal link to selectively disengage therefrom, and the second plane being arcuate so as to allow each link to lie flat on the skin of the user.

4 Claims, 2 Drawing Sheets

JEWELRY CHAIN

BACKGROUND OF THE INVENTION

1. Field of the Invention

The present invention relates to a jewelry chain. More particularly, the present invention relates to an improved Jewelry chain.

2. Description of the Prior Art

Numerous innovations for chains have been provided in the prior art that will be described. Even though these innovations may be suitable for the specific individual purposes to which they address, however, they differ from the present invention.

A FIRST EXAMPLE, U.S. Pat. No. 1,655,763 to Fulford teaches an ornamental chain formed of a series of connected links, each having a body frame substantially heart-shaped in outline, and a head member including an integral bendable link-connecting hook-shaped neck portion extending upwardly from the plane of the bottom of the body frame, laterally extending wing portions on said head member arranged to extend across the frame opening to engage opposite sides thereof on bending of said neck portion, said neck portion being adapted to receive the body frame of an adjacent link and said wing portions acting to limit the movement of said received body frame about the neck portion.

A SECOND EXAMPLE, U.S. Pat. No. 2,007,445 to Goldenberg teaches an ornamental chain comprising a plurality of units of relatively soft metal, each unit consisting of horizontally convexo-concave body segments provided upon their forward ends with points and with abutments and at their rear ends with abutments, a cross bar connecting the forward abutments, a longitudinally disposed tongue between the segments adapted to receive the cross bar of an adjacent unit comprising an upwardly directed rear portion and a downwardly inclined forward portion, spacing bars connecting the rear abutments to the lower end of the rear portion of the tongue to loosely receive the points of an adjacent unit therebetween, and projections upon the segments fixed to the forward portion of the tongue.

A THIRD EXAMPLE, U.S. Pat. No. 5,636,506 to Yngvesson teaches a chain link and a method for the production thereof as well as a chain consisting of connected chain links and a connecting part for connecting chain links. The chain link consists of an endless elongated rod-like part which is characterized in that it is shaped as two pairs of loops and wherein the loops in each pair are substantially parallel and the pairs are arranged in two planes which are turned through 90 degrees with respect to each other. The connecting part consists of a semi-finished chain link and the chain consists of connected chain links as well as possibly connecting parts.

A FOURTH EXAMPLE, U.S. Pat. No. 5,664,410 to Nydick teaches a link and a chain formed therefrom, wherein the links comprise a shaft portion having first and second opposing ends defining therebetween a longitudinal axis for the link; an enlargement portion connected to the shaft portion at the first end, the enlargement portion having a width which is greater than a width of the shaft portion at the first end; and a mandorla shaped portion having first and second apertures therein, the mandorla shaped portion being connected to the shaft portion at the second end, and the apertures being shaped so as to prevent the enlargement portion from passing therethrough.

A FIFTH EXAMPLE, U.S. Pat. No. 6,055,802 to DiVietri teaches a chain 10 whose configuration can best be seen in FIGS. 1–3, and as such, will be discussed with reference thereto.

As shown in FIG. 1, the chain 10 is formed from a plurality of links 12, each of which resembles a fish hook 14 and has a shank 16 with one end 18 thereof having a barbed hook 20 thereon and an opposite end 22 having an eyelet 24 thereon that engages the barbed hook 20 of an adjacent link 12 so as to form the chain 10.

As shown in FIG. 2, the barbed hook 20 of each link 12 touches the shank 16 of an associated link 12 so as to be closed, except, as shown in FIG. 1, wherein the barbed hook 20 of one terminal link 12 does not touch the shank 16 so as to allow the barbed hook 20 of the one terminal link 12 to selectively disengage from the eyelet 24 of the other terminal link 12 so as to allow the chain 10 to be donned.

As shown in FIG. 3, the eyelet 24 of each link 12 lies in a first plane and the shank 16 and barbed hook 20 of each link 12 lie a second plane that is perpendicular to the first plane and which is flat, and as a result thereof, each link 12 does not lie flat on the skin of the user.

It is apparent that numerous innovations for chains have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide an improved jewelry chain that avoids the disadvantages of the prior art.

ANOTHER OBJECT of the present invention is to provide an improved jewelry chain that is simple and inexpensive to manufacture.

STILL ANOTHER OBJECT of the present invention is to provide an improved jewelry chain that is simple to use.

BRIEFLY STATED, STILL YET ANOTHER OBJECT of the present invention is to provide an improved jewelry chain of a type having a plurality of links. Each link resembles a fish hook and has a shank with one end thereof having a barbed hook thereon and an opposite end thereof having an eyelet thereon which engages the barbed hook of an adjacent link. The eyelet lies in a first plane and the shank and barbed hook lie in a second plane that is perpendicular to the first plane. The improvements include the barbed hook not touching the shank, the eyelet being so sized so as not to allow the barbed hook of an adjacent link to pass therethrough, except for the eyelet of one terminal link being large enough to allow the barbed hook of the other terminal link to selectively disengage therefrom, and the second plane being arcuate so as to allow each link to lie flat on the skin of the user.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

DESCRIPTION OF THE DRAWING

The figures of the drawing are briefly described as follows.

LIST OF REFERENCE NUMERALS UTILIZED IN THE DRAWING

Prior Art

Figure 1:
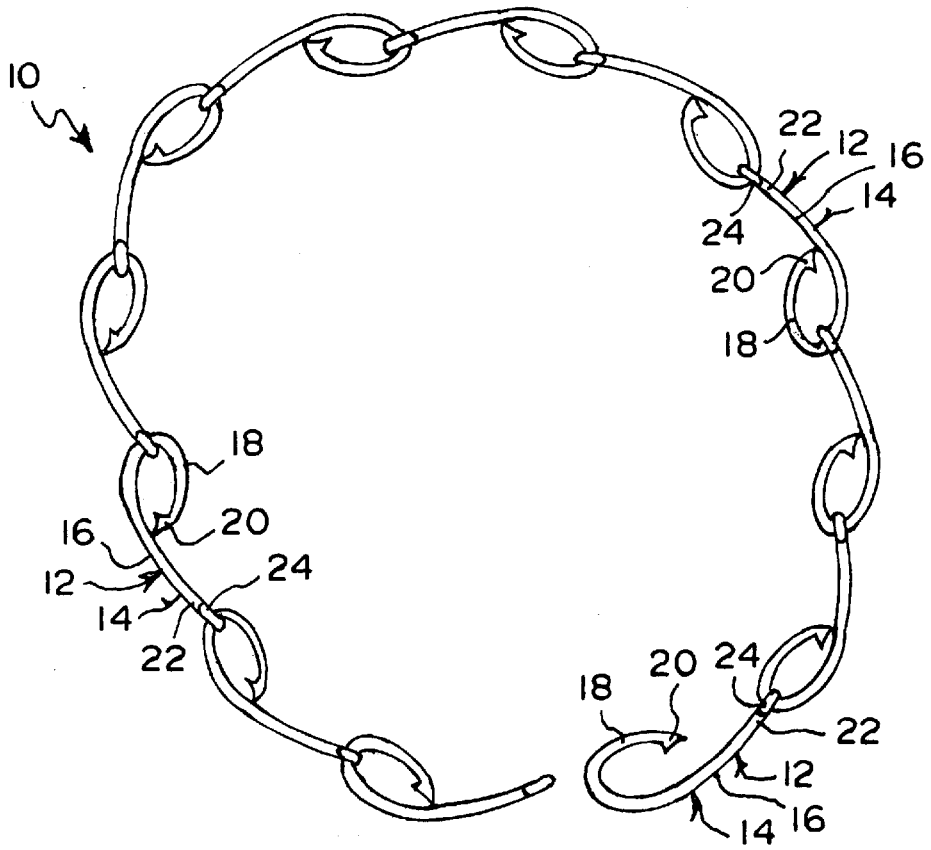
Fig. 1 (PRIOR ART)
FIG. 1 is a diagrammatic top plan view of a prior art jewelry chain.
Figure 2:
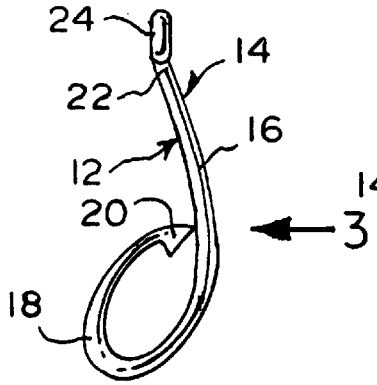
Fig. 2 (PRIOR ART)
FIG. 2 is an enlarged diagrammatic side elevational view of a link of the prior art Jewelry chain shown in FIG. 1.
Figure 3:
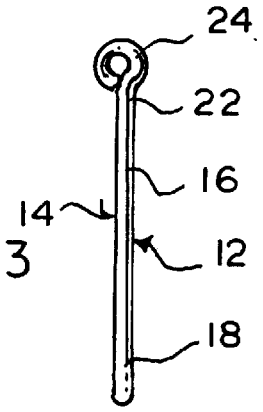
Fig. 3 (PRIOR ART)
FIG. 3 is a diagrammatic rear elevational view taken generally in the direction of arrow 3 in FIG. 2.

10 chain
12 plurality of links, each of which resembling fish hook 14
14 fish hook
16 shank of each link of plurality of links 12
18 one end of shank 16 of each link of plurality of links 12
20 barbed hook on one end 18 of shank 16 of each link of plurality of links 12
22 opposite end of shank 16 of each link of plurality of links 12
24 eyelet on opposite end 22 of shank 16 of each link of plurality of links 12

Present Invention

30 improved jewelry chain of present invention
32 plurality of links
34 fish hook
36 shank of each link of plurality of links 32
38 one end of shank 36 of each link of plurality of links 32
40 barbed hook on one end 38 of shank 36 of each link of plurality of links 32
42 opposite end of shank 36 of each link of plurality of links 32
44 eyelet on opposite end 42 of shank 36 of each link of plurality of links 32

DESCRIPTION OF THE PREFERRED EMBODIMENT

Figure 4:
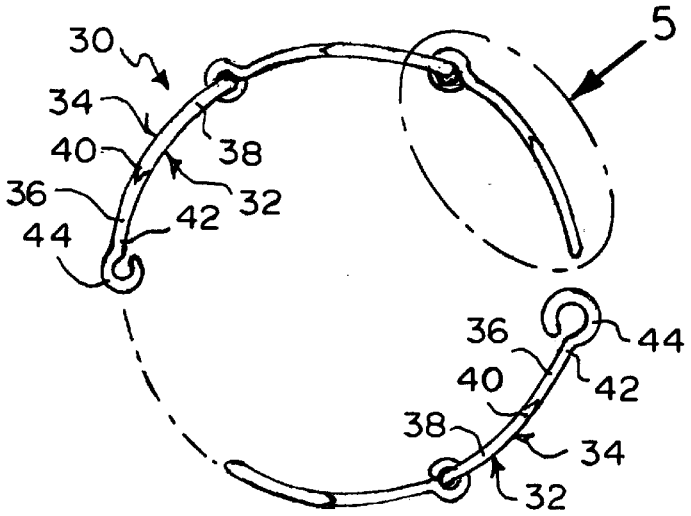
FIG. 4 is a diagrammatic top plan view of the present invention.

Referring now to the figures, in which like numerals indicate like parts, and particularly to FIG. 4, the improved jewelry chain of the present invention is shown generally at 30.

The improved jewelry chain 30 is formed from a plurality of links 32.

The configuration of each link 32 can best be seen in FIGS. 5 and 6, and as such, will be discussed with reference thereto.

Each link 32 resembles a fish hook 34 and has a shank 36 with one end 38 thereof having a barbed hook 40 thereon and an opposite end 42 thereof having an eyelet 44 thereon.

The links 32 are connected to each other by the barbed hook 40 of one link 32 engaging the eyelet 44 of an adjacent link 32.

Figure 5:
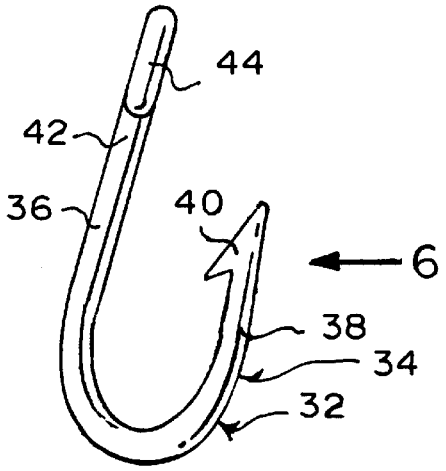
FIG. 5 is an enlarged diagrammatic side elevational view of the area generally enclosed by the dotted curve identified by arrow 5 in FIG. 4 of a link of the present invention.

As shown in FIG. 5, the improvement comprises the barbed hook 40 of each link 32 not touching the shank 36 of an associated link 22 so as to be open.

The improvement further comprises the eyelet 44 of each link 32 being so sized so as not to allow the barbed hook 40 of an adjacent link 32 to pass therethrough, except, as shown in FIG. 4, wherein the eyelet 44 of one terminal link 32 is large enough to allow the barbed hook 40 of the other terminal link 32 to selectively disengage therefrom so as to allow the improved jewelry chain 30 to be donned.

Figure 6:
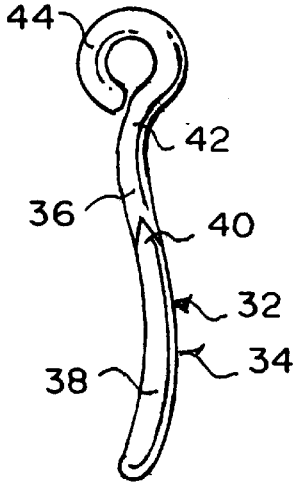
FIG. 6 is a diagrammatic front elevational view taken generally in the direction of arrow 6 in FIG. 5.

As shown in FIG. 6, the improvement further comprises the eyelet 44 of each link 32 lying in a first plane and the shank 36 and barbed hook 40 of each link 32 lying in a second plane that is perpendicular to the first plane and which is arcuate so as to allow each link 32 to lie flat on the skin of the user.

Figure 7:
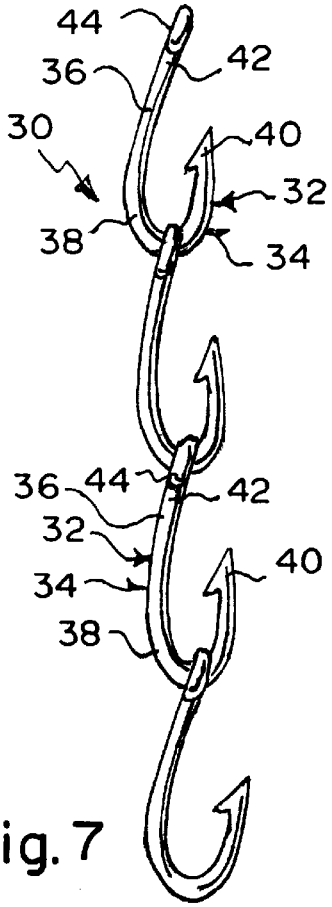
FIG. 7 is diagrammatic side elevational view of one orientation of the links of the present invention.

As shown in FIG. 7, each link of the plurality of links 32 faces in a same direction.

Figure 8:
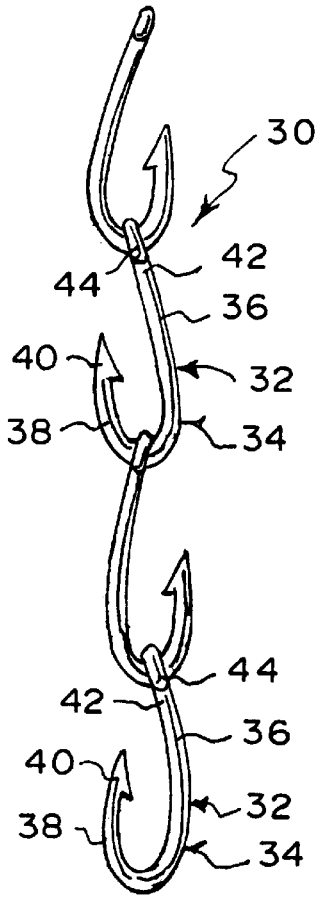
FIG. 8 is diagrammatic side elevational view of another orientation of the links of the present invention.

As shown in FIG. 8, alternating links of the plurality of links 32 face in a same direction.

It will be understood that each of the elements described above, or two or more together, may also find a useful application in other types of constructions differing from the types described above.

While the invention has been illustrated and described as embodied in an improved jewelry chain, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. An improved jewelry chain of a type having a plurality of links, each of which resembling a fish hook and having a shank with one end thereof having a barbed hook thereon and an opposite end thereof having an eyelet thereon which engages the barbed hook of an adjacent link so as to form the chain and the eyelet of each link lies in a first plane and the shank and barbed hook of each link lie in a second plane that is perpendicular to the first plane, said improvement comprising the barbed hook of each link not touching the shank of an associated link so as to be open.

2. The improvement as defined in claim 1, wherein said improvement further comprises the eyelet of each link being so sized so as not to allow the barbed hook of an adjacent link to pass therethrough, except for the eyelet of one terminal link being large enough to allow the barbed hook of the other terminal link to selectively disengage therefrom so as to allow the improved jewelry chain to be donned.

3. The improvement as defined in claim 1, wherein said improvement further comprises the second plane being arcuate so as to allow each link to lie flat on the skin of the user.

4. The improvement as defined in claim 1, wherein said improvement further comprises alternating links of the plurality of links face in a same direction.

* * * * *